US007475973B2

(12) United States Patent
Kruijt

(10) Patent No.: US 7,475,973 B2
(45) Date of Patent: Jan. 13, 2009

(54) SHEET HANDLING DEVICE WITH A TEMPERATURE CONTROLLED SHEET SUPPORT PLATE

(75) Inventor: Pieter G. M. Kruijt, HE Eindhoven (NL)

(73) Assignee: Oce-Technologies B.V., Venlo (NL)

( * ) Notice: Subject to any disclaimer, the term of this patent is extended or adjusted under 35 U.S.C. 154(b) by 447 days.

(21) Appl. No.: 11/240,557

(22) Filed: Oct. 3, 2005

(65) Prior Publication Data

US 2006/0071996 A1 Apr. 6, 2006

(30) Foreign Application Priority Data

Oct. 4, 2004 (EP) ..... 04104858

(51) Int. Cl.
*B41J 2/175* (2006.01)
*B41J 2/01* (2006.01)

(52) U.S. Cl. ..... 347/88; 347/104

(58) Field of Classification Search ..... 347/30, 347/88, 89, 99, 2, 101, 102, 104; 271/91–98, 271/194, 195, 197, 276; 399/88; 101/488; 248/362; 355/73, 76
See application file for complete search history.

(56) References Cited

U.S. PATENT DOCUMENTS 4,269,586 A * 5/1981 Ronayne ..... 425/407
5,043,741 A * 8/1991 Spehrley, Jr. ..... 347/88
5,272,491 A * 12/1993 Asakawa et al. ..... 347/18
6,022,104 A * 2/2000 Lin et al. ..... 347/102
6,315,404 B1 * 11/2001 Wotton et al. ..... 347/102
2002/0071016 A1 6/2002 Wotton et al.
2005/0024457 A1 * 2/2005 Hilton et al. ..... 347/87

FOREIGN PATENT DOCUMENTS

EP 0870622 A1 * 10/1998
JP 403157678 A * 7/1991
JP 2003-262482 A 9/2003

* cited by examiner

*Primary Examiner*—Stephen D Meier
*Assistant Examiner*—Geoffrey Mruk
(74) *Attorney, Agent, or Firm*—Birch, Stewart, Kolasch & Birch, LLP

(57) ABSTRACT

A sheet handling device including a sheet support plate made of a heat conductive material having a first heat capacity, said plate having at least one cavity formed between a top wall defining a top surface of the plate and a bottom wall defining a bottom surface of the plate; and a temperature control system including a circulating system for circulating a temperature control fluid through said cavity, wherein in the cavity contains a displacement body which is spaced apart from said top and bottom walls and is made of a material having a heat capacity which is smaller than the heat capacity of the sheet support plate.

11 Claims, 2 Drawing Sheets

SHEET HANDLING DEVICE WITH A TEMPERATURE CONTROLLED SHEET SUPPORT PLATE

BACKGROUND OF THE INVENTION

The present invention relates to a sheet handling device containing: a sheet support plate made of a heat conductive material having a first heat capacity, said plate having at least one cavity formed between a top wall defining a top surface of the plate and a bottom wall defining a bottom surface of the plate; and a temperature control system including a circulating system for circulating a temperature control fluid through the cavity.

In the copying and printing industry, a temperature controlled sheet support plate is frequently used for supporting an image receiving sheet and at the same time controlling the temperature thereof. For example, in a hot melt ink jet printer, a sheet, e. g. a sheet of paper, is advanced over a sheet support plate while the image is being printed. At room temperature, the hot melt ink is solid, and it is therefore necessary that the ink is heated in the printer above its melting point, before it can be jetted onto the paper. The ink droplets that have been jetted onto the paper tend to spread-out more or less before the ink solidifies. In order to obtain a suitable and constant amount of spreading of the ink droplets, the temperature of the sheet support plate and hence the temperature of the paper should be controlled such that the ink cools down at an appropriate rate.

In the initial phase of the print process, when a new sheet has been supplied, it is generally desirable to heat the sheet and to keep it at a suitable operating temperature. However, in the further course of the print process, it is necessary to dissipate the heat of the ink that solidifies on the paper. To that end, a temperature control fluid, e. g. a liquid, may be passed through the cavity in the plate in order to control the temperature of the plate.

Moreover, in order to obtain a good print quality, the surface of the sheet support plate should be perfectly flat, at least in the region where the image is being printed. Thus, the support plate should have a sufficient strength so that it will not bend under mechanical or thermal stress. As a result, the plate must have a certain minimum thickness, and this implies a certain minimum volume of the cavity.

For reasons of power consumption, it is required that the printer enters into a so-called sleep mode, when the printer is not operating for a certain period of time, and in the sleep mode, among others, the heating system for the sheet support plate is switched off. As a result, when a new image is to be printed, it will take a certain amount of time until the sheet support plate can be heated to its operating temperature.

SUMMARY OF THE INVENTION

It is an object of the present invention to provide a sheet handling device in which the sheet support plate can quickly be brought to its operating temperature.

According to the present invention, this object is achieved by a sheet handing device of the type indicated above, wherein the cavity contains a displacement body which is spaced apart from the top wall of the cavity and is made of a material having a second heat capacity which is smaller that said first heat capacity of the material of the plate.

The displacement body reduces the effective volume of the cavity but, thanks to its smaller heat capacity, does not significantly increase the overall heat capacity of the plate. As a result, the volume of the temperature control fluid that is needed for filling the cavity is reduced and, consequently, less time and/or heating power is needed for heating the fluid and hence the plate to its operating temperature.

As an additional advantage, the Reynolds number for the flow of fluid through the cavity is increased, which results in an improved heat exchange between the fluid and the plate.

When the displacement body is spaced apart from both the top wall and the bottom wall of the cavity, the fluid may circulate through hollow spaces near both the top wall and the bottom wall of the cavity, so that the top and bottom surfaces of the plate may always be kept on the same temperature and a thermal distortion of the plate is prevented.

In a preferred embodiment, the sheet support plate has a plurality of elongated cavities which extend in parallel through the plate and are separated by separating walls. This assures a high rigidity of the plate. The separating walls may be formed with trough-holes which connect the top surface of the plate to a suction chamber provided at the bottom surface thereof, so that the sheet may be drawn against the top surface of the plate. This assures a perfectly flat configuration of the sheet, especially in the region where the image is being formed, and at the same time assures a good thermal contact between the sheet and the plate.

The displacement bodies may be formed by bars made of a synthetic resin such as polystyrene, which are inserted into each of the cavities and may easily be manufactured as extruded profiles or the like. Preferably, the displacement bodies are in contact with the separating walls of the plate, so that each cavity is divided into two passages which extend near the top surface and the bottom surface, respectively, of the plate and are only connected to one another and to the circulating system at the respective ends of the cavities.

According to a further development of the present invention, the displacement bodies may be made of a material which shows a phase transition with a relatively high latent heat at a transition temperature close to the operating temperature of the plate. For example, the transition may be one between a liquid state and a crystalline, semi-crystalline or amorphous solid state. Thus, when the temperature of the plate exceeds the transition temperature, the displacement bodies or at least parts thereof may melt, with absorption of latent heat, so that the temperature of the plate is returned to the operating temperature. Conversely, when the temperature drops below the transition temperature, the displacement bodies will solidify and will release the latent heat. Thus, the temperature of the plate is stabilized at the operating temperature.

In a particularly preferred embodiment, at least part of the material of the displacement bodies, is in the high-temperature state, e. g. the molten state, when the plate has its operating temperature. Then, when the printer enters into the sleep mode and the heating system for the plate, i. e. the heating system which heats the temperature control fluid, is switched off, the displacement bodies will release their latent heat, and the cooling-down of the plate is delayed. As a result, when the printer is activated again after a short interval, the plate will still have a high temperature, and the operating temperature may quickly be re-established with reduced energy consumption.

BRIEF DESCRIPTION OF THE DRAWINGS

Preferred embodiments of the present invention will now be described in conjunction with the drawings, in which.

DETAILED DESCRIPTION OF THE INVENTION

Figure 1:
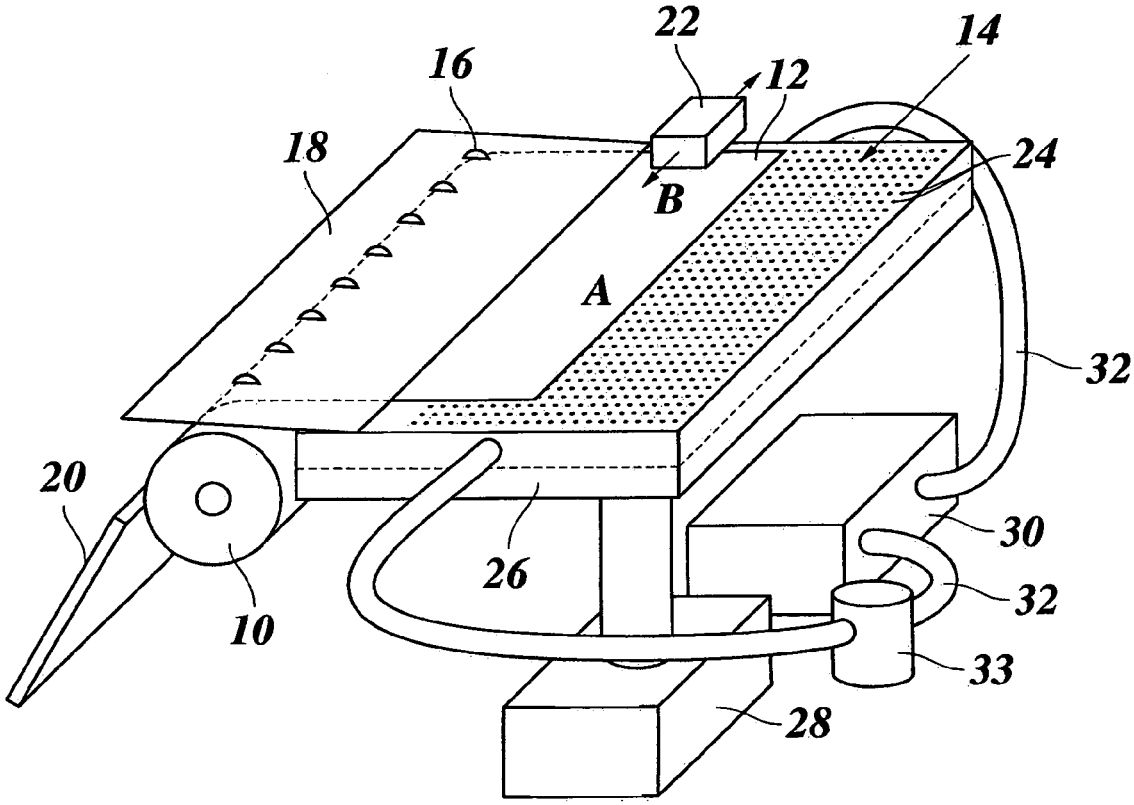
FIG. 1 is a schematic perspective view of a hot melt ink jet printer.

As is shown in FIG. 1, a hot melt ink jet printer includes a platen 10 which is intermittently driven to rotate in order to advance a sheet 12, e. g. a sheet of paper, in a direction indicated by an arrow A over the top surface of a sheet support plate 14. A number of transport rollers 16 are rotatably supported in a cover plate 18 and form a transport nip with the platen 10, so that the sheet 12, which is supplied from a reel (not shown) via a guide plate 20, is paid out through a gap formed between an edge of the cover plate 18 and the surface of the sheet support plate 14.

A carriage 22 which includes a number of ink jet printheads (not shown) is mounted above the sheet support plate 14 so as to reciprocate in the direction of arrows B across the sheet 12. In each pass of the carriage 22, a number of pixel lines are printed on the sheet 12 by means of the printheads which eject droplets of hot melt ink onto the sheet in accordance with image information supplied to the printheads. For the sake of simplicity, guide and drive means for the carriage 22, ink supply lines and data supply lines for the printheads, and the like, have not been shown in the drawing.

The top surface of the sheet support plate 14 has a regular pattern of suction holes 24 which pass through the plate and open into a suction chamber 26 that is formed in the lower part of the plate 14. The suction chamber is connected to a blower 28 which creates a subatmospheric pressure in the suction chamber, so that air is drawn-in through the suction holes 24. As a result, the sheet 12 is drawn against the flat surface of the support plate 14 and is thereby held in a flat condition, especially in the area which is scanned by the carriage 22, so that a uniform distance between the nozzles of the printheads and the surface of the sheet 12 is established over the whole width of the sheet and a high print quality can be achieved.

The droplets of molten ink that are jetted out from the nozzles of the printheads have a temperature of 100° C. or more and cool down and solidify after they have been deposited on the sheet 12. Thus, while the image is being printed, the heat of the ink must be dissipated with a sufficient rate. On the other hand, in the initial phase of the image forming process, the temperature of the sheet 12 should not be too low, because otherwise the ink droplets on the sheet 12 would be cooled too rapidly and would not have time enough to spread-out. For this reason, the temperature of the sheet 12 is controlled via the sheet support plate 14 by means of a temperature control system 30 which circulates a temperature control fluid, preferably a liquid, through the plate 14. The temperature control system includes a circulating system with tubes 32 that are connected to opposite ends of the plate 14. One of the tubes passes through an expansion vessel 33 containing a gas buffer for absorbing temperature-dependent changes in the volume of the liquid. As will be readily understood, the temperature control system 30 includes heaters, temperature sensors, heat sinks, and the like for controlling the temperature of the fluid, as well as a pump or other displacement means for circulating the fluid through the interior of the sheet support plate 14, as will now be described in detail in conjunction with FIG. 2.

Figure 2:
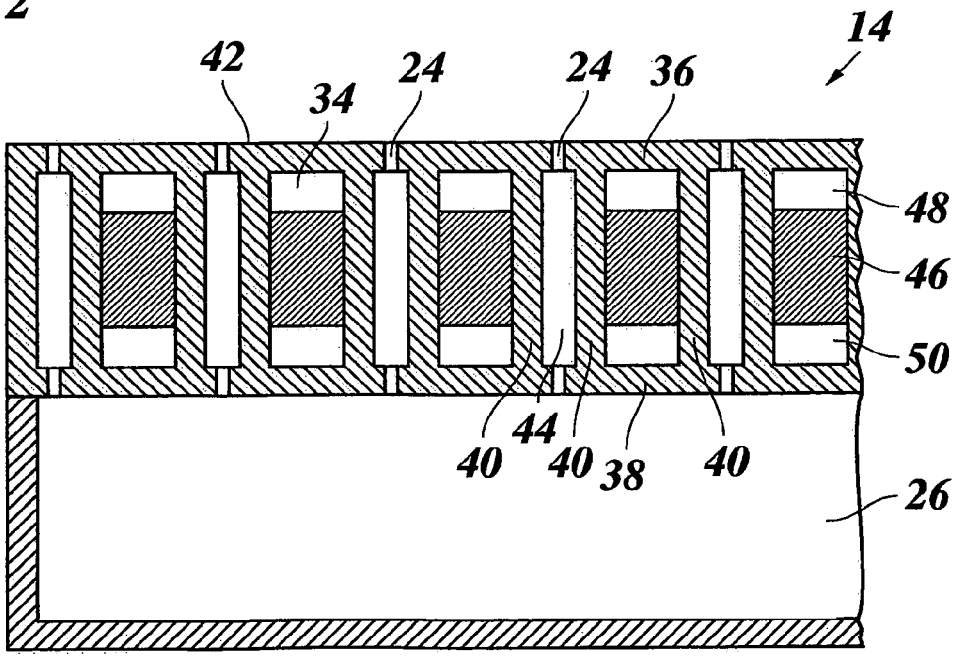
FIG. 2 is a partial cross-section of a sheet support plate in the printer shown in FIG. 1.

The sheet support plate 14, which has been shown in cross-section in FIG. 2, is made of a material, such as a metal, having a relatively high heat conductivity and also a relatively high heat capacity. A number of elongated cavities 34 are formed in the interior of the plate 14 so as to extend in parallel with one another and in parallel with the direction (B) of travel of the carriage 22 between opposite ends of the plate 14, where they are connected to the tubes 32 through suitable manifolds. Each cavity 34 is delimited by a top wall 36, a bottom wall 38 and two separating walls 40. The top walls 36, together, define the top surface 42 of the plate 14 which is machined to be perfectly flat. Between each pair of two separating walls 40, which delimit to adjacent cavities 34, a hollow space 44 is formed, through which the suction holes 24 pass through into the suction chamber 26.

As is further shown in FIG. 2, a bar-shaped displacement body 46 having a rectangular cross-section has been inserted in medium height in each of the cavities 34, so that each cavity is divided, over its entire length, into two separate passages 48, 50, and the effective volume of the cavity 34 is reduced significantly. The displacement bodies 46 are made of polystyrene, for example, and in any case have a heat capacity that is significantly lower than that of the material of the plate 14. Thus, the bodies 46 do not substantially add to the overall heat capacity of the sheet support plate 14 and, accordingly, do not increase the amount of time and energy needed for heating the plate 14 to a predetermined temperature. On the other hand, since the volume of the cavities 34 is reduced, a comparatively small amount of temperature control fluid is sufficient for filling the channels 48, 50 completely, and only this reduced amount of fluid needs to be heated or cooled in order to control the temperature of the plate 14. Moreover, since the cross-sectional area of the cavity 34 is reduced to that of the passages 48, 50, the Reynolds number for a given volume flow rate of the fluid is increased, and this improves the efficiency of heat exchange between the fluid and the walls of the plate 14.

The displacement bodies 46 may, for example, be held in place in the cavities 34 by means of an adhesive. As an alternative, the profile of the plate 14 may be modified such that the separating walls 40 are provided with ribs for guiding and supporting the displacement bodies 46. In yet another alternative, only the end portions of the bar-shaped displacement bodies 46 may be held in position in the manifolds at both ends of the plate 14.

Preferably, the fluid flows through the passages 48 and 50 of each cavity 34 in the same direction, so that the temperature of the bottom wall 38 of the cavities will always be equal to temperature of the top wall 36, and the plate 14, as a whole, is not caused to bend due to differential thermal expansion.

In a modified embodiment, a more complex circulating system may be used which causes the fluid in adjacent cavities 34 to flow in opposite directions, so as to minimize a possible temperature gradient in the lengthwise direction (arrow B) of the plate 14. In this case, it is also possible to connect the passages 48, 50 with one another at one end of the cavity 34 and to connect the two passages to different tubes 32 at the opposite end, so that the fluid is caused to circulate in countercurrent fashion within each of the cavities 34, but with opposite sense in adjacent cavities.

When the printer is switched on, the heater integrated in the temperature control system 30 will heat the fluid, and the fluid will be circulated through the passages 48, 50 until the plate 14 has been brought to its operating temperature, i.e. a temperature which assures an appropriate cooling rate for the droplets of hot melt ink that have been jetted onto the paper. Since the volume of fluid to be heated is small, the required operating temperature can be reached in a reduced time and with reduced power consumption.

As the print process continues, the sheet 12 and the plate 14 will be heated by the ink deposited on the sheet, and the temperature control system 30 switches from a heating mode to a temperature control mode in order to keep the temperature of the plate 14 constant. Since at least one half of the fluid circulating through the cavities 34 is forced to pass through the passages 50 near the bottom walls 38 of the cavities, these bottom walls 38, which are exposed to the suction chamber 26, may efficiently be used as heat sinks which prevent the temperature of the fluid from increasing beyond a tolerable limit. Moreover, the reduced volume of fluid shortens the response time for the thermostatic control.

Figure 3:
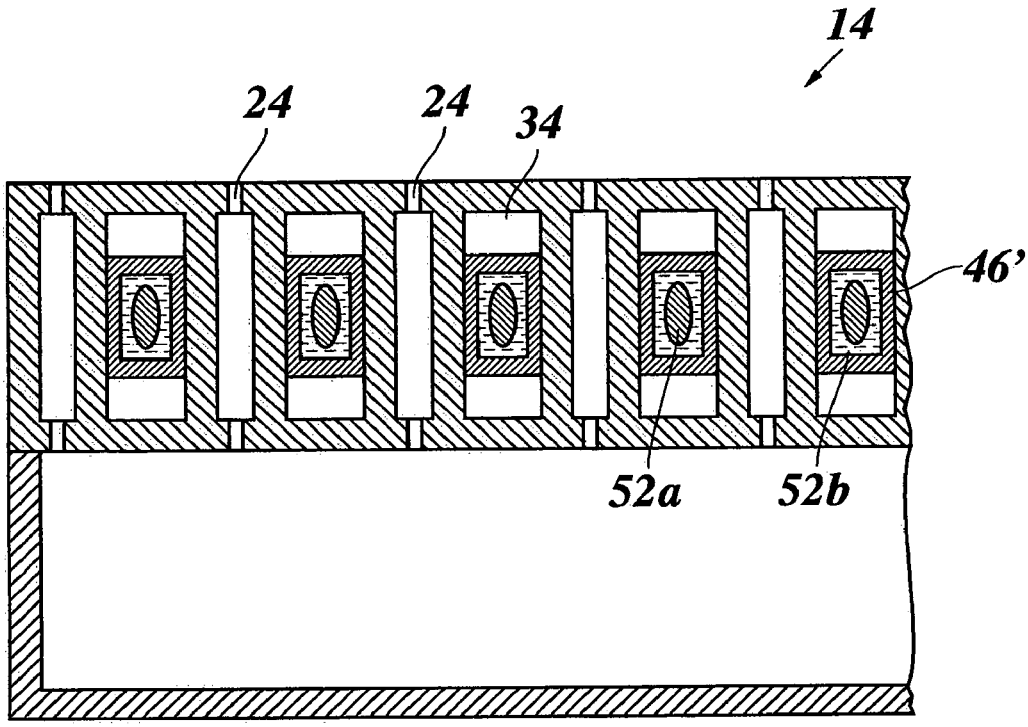
FIG. 3 is a partial cross-section of a sheet support plate according to a modified embodiment.

FIG. 3 shows a modified embodiment of the sheet support plate 14, in which displacement bodies 46' in the cavities 34 are hollow bodies which enclose a material 52*a*, 52*b*, e. g. a wax or the like, which, at a certain transition point or in a transition temperature range, undergoes a transition between a high-temperature phase 52*b* and a low temperature phase 52*a* with release of latent heat. The transition point or range is equal to or close to the operating temperature of the plate 14. In the condition shown in FIG. 3, which corresponds to the operating condition of the plate 14, only part of the material contained in the bodies 46' is in the low-temperature phase 52*a* and forms a solid core, whereas the rest of the material is in a molten state, i. e. the high-temperature phase 52*b*.

Figure 4:
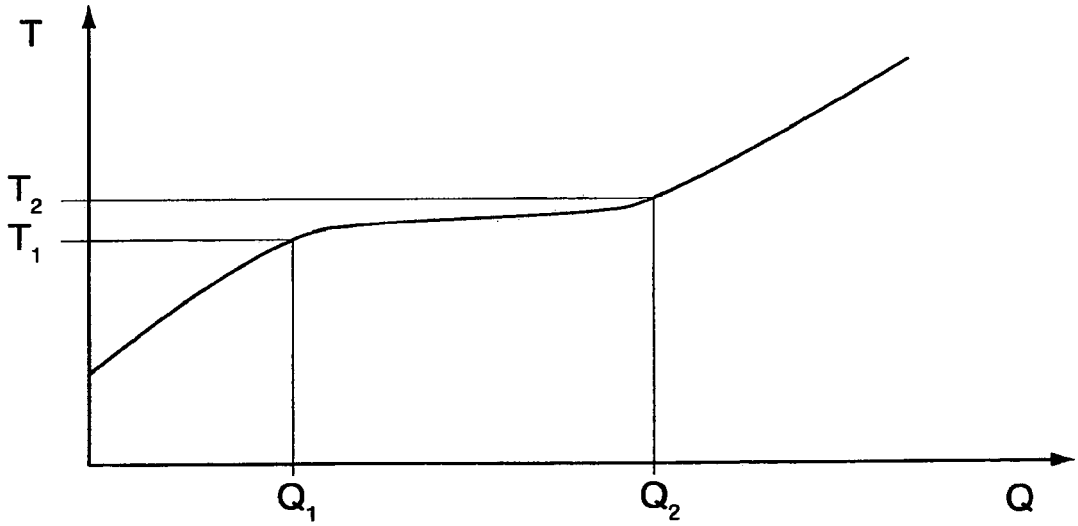
FIG. 4 is a temperature/heat-diagram for a material used in the plate shown in FIG. 3.

In FIG. 4, the temperature T of the material 52*a*, 52*b* has been shown as a function of the heat content Q of a given volume of this material. It can be seen that, within a narrow transition temperature range from $T_1$ to $T_2$, the heat content increases drastically from $Q_1$ to $Q_2$, corresponding to the latent heat of the phase transition. As a result, the temperature of the material 52*a*, 52*b* and, therewith, the temperature of the plate 14 can easily be stabilized in the range between T1 and T2, i. e. at the operating temperature.

When the printer enters into a sleep-mode and the heater in the temperature control system 30 is switched off, the core 52*a* grows on the cost of the molten phase 52*b* and the latent heat is released, so that the plate 14 will essentially retain its operating temperature for an extended time period. When the printer becomes operative again before this time period has lapsed, the print process can start immediately, because the plate 14 still has its operating temperature. If the sleep-mode continues for a longer time period, the temperature drops below $T_1$, but when the heater is switched on again, the temperature $T_1$ and hence the operating temperature can quickly be recovered by supplying only a little amount of heat.

In more general terms, what is proposed here is a paper handling device including a sheet support plate 14, heating and temperature control means 30 for heating the sheet support plate 14 to a predetermined operating temperature and keeping it at that temperature, and buffer bodies 46' integrated in the sheet support plate 14, said buffer bodies containing a material 52*a*, 52*b*, which, at a temperature point or in a temperature range $T_1$-$T_2$ at or near the operating temperature, undergoes a phase transition from a high-temperature phase 52*b* to a low-temperature phase 52*a* with the release of latent heat.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A sheet handling device comprising a sheet support plate made of a heat conductive material having a first heat capacity, said plate having at least one cavity formed between a top wall defining a top surface of the plate and a bottom wall defining a bottom surface of the plate; and a temperature control system including a circulating system for circulating a temperature control fluid through said cavity wherein the cavity contains a displacement body which is spaced apart from said top wall and is made of a material having a second heat capacity which is smaller than said first heat capacity.

2. The sheet handling device of claim 1, wherein said displacement body is also spaced apart from the bottom wall of the cavity.

3. The sheet handling device, of claim 1, wherein said displacement body is made of a synthetic resin.

4. The sheet handling device of claim 3, wherein the displacement body is made of polystyrene.

5. The sheet handling device of claim 1, wherein said plate contains a plurality of cavities arranged in parallel to one another and separated by separating walls of said material with said first heat capacity.

6. The sheet handling device of claim 5, wherein the sheet support plate contains suction holes passing through from the top surface to the bottom surface of the plate and separated from the cavities by the separating walls.

7. The sheet handling device of claim 1, wherein the displacement body is a material, which, at a predetermined temperature or within a predetermined temperature range ($T_1$-$T_2$), undergoes a phase transition from a high-temperature phase to a low-temperature phase with a release of latent heat.

8. A hot melt ink jet printer containing a sheet handling device according to claim 1.

9. The sheet handling device of claim 5, wherein a displacement body is disposed in each of said plurality of cavities.

10. The sheet handling device of claim 9, wherein the displacement bodies are in contact with the separating walls of the plate so that each cavity is divided into two passages which extend near the top surface and the bottom surface of the support plate.

11. The sheet handling device of claim 8, wherein the material of the displacement body is in a high-temperature state when the support plate is operating, but releases its latent heat to delay the cooling-down of the support plate when the printer is shut down.

* * * * *